US005670473A

United States Patent [19]

Scepanski

[11] Patent Number: 5,670,473

[45] Date of Patent: Sep. 23, 1997

[54] SOLID CLEANING COMPOSITIONS BASED ON HYDRATED SALTS

[75] Inventor: William H. Scepanski, Bloomington, Minn.

[73] Assignee: Sunburst Chemicals, Inc., Minneapolis, Minn.

[21] Appl. No.: 467,213

[22] Filed: Jun. 6, 1995

[51] Int. Cl.[6] ..... C11D 17/00; C11D 3/06

[52] U.S. Cl. ..... 510/445; 510/108; 510/214; 510/224; 510/225; 510/294; 510/351; 510/356; 510/361; 510/378; 510/447; 510/467; 510/476; 510/477; 510/480; 510/495; 510/512

[58] Field of Search ..... 252/89.1, 174, 252/135; 510/157, 294, 345, 445, 447, 224, 225, 351, 378, 356, 361, 467, 476, 477, 480, 495, 512

[56] References Cited

U.S. PATENT DOCUMENTS

| | | | |
|---|---|---|---|
| Re. 32,763 | 10/1988 | Fernholtz et al. | 252/90 |
| Re. 32,818 | 1/1989 | Fernholz et al. | 252/90 |
| 3,839,214 | 10/1974 | Schwalley et al. | 252/106 |
| 4,033,894 | 7/1977 | McLaughlin et al. | 252/99 |
| 4,219,435 | 8/1980 | Biard et al. | 252/90 |
| 4,333,844 | 6/1982 | Duggleby et al. | 252/97 |
| 4,427,417 | 1/1984 | Porasik | 23/313 R |
| 4,430,246 | 2/1984 | Sorbe et al. | 252/140 |
| 4,451,386 | 5/1984 | Joshi | 252/135 |
| 4,595,520 | 6/1986 | Heile et al. | 252/160 |
| 4,680,134 | 7/1987 | Heile et al. | 252/160 |
| 4,681,696 | 7/1987 | Bruegge et al. | 252/99 |
| 4,681,914 | 7/1987 | Olson et al. | 252/91 |
| 4,725,376 | 2/1988 | Copeland | 252/90 |
| 4,769,159 | 9/1988 | Copeland | 252/8.8 |
| 4,781,855 | 11/1988 | Shaw et al. | 252/135 |
| 4,800,055 | 1/1989 | Klee et al. | 264/118 |
| 4,828,745 | 5/1989 | Jeschke et al. | 252/99 |
| 4,839,078 | 6/1989 | Kruse et al. | 252/99 |
| 4,846,989 | 7/1989 | Killa | 252/99 |
| 4,861,518 | 8/1989 | Morganson et al. | 252/548 |
| 4,913,832 | 4/1990 | Kruse et al. | 252/99 |
| 4,915,872 | 4/1990 | Ciuba et al. | 252/389.3 |
| 4,933,102 | 6/1990 | Olson | 252/174 |
| 5,080,819 | 1/1992 | Morganson et al. | 252/90 |
| 5,340,501 | 8/1994 | Steindorf | 252/546 |
| 5,397,506 | 3/1995 | Groth et al. | 252/547 |
| 5,419,850 | 5/1995 | Backes et al. | 252/174 |

OTHER PUBLICATIONS

Weast, R. C. Handbook of Chemistry and Physics, Ohio, The Chemical Rubber Co., 1964. pp. 220, 223.

*Primary Examiner*—Paul Lieberman
*Assistant Examiner*—Lorna M. Douyon
*Attorney, Agent, or Firm*—Patterson & Keough, P.A.

[57] ABSTRACT

A method for forming solid cleaning agents starts with hydrated forms of salts that generally have considerably lower melting points in their hydrated forms. The hydrated salt cleaning agents are heated to form a melted cleaning suspension. Additional ingredients can be mixed into the melted cleaning suspension. These additional ingredients can be selected from the group consisting of nonionic surfactants, anionic surfactants, alkaline builders, multivalent metal sequestering agents, active enzymes, soil suspending agents, defoamers, oxygenated solvents, fragrances, optical brighteners and colorants. An alternative method involves the formation of a mixture of powder or granular cleaning composition components. These components include at least 15 percent by weight of a moderate melting point cleaning additive. A receptacle with the cleaning components is heated to a temperature above the melting point of the moderate melting point cleaning additive. After sufficient time, the heating is stopped, and the mixture solidifies into a solid cleaning composition. A class of novel solid cleaning compositions comprise at least 15 percent a hydrated melt salt cleaning agents. The solid cleaning compositions can have additional additives.

3 Claims, No Drawings

SOLID CLEANING COMPOSITIONS BASED ON HYDRATED SALTS

FIELD OF THE INVENTION

The invention relates to solid cleaning compositions based on hydrated salts that have melting points significantly less than the corresponding anhydrous salt. The invention more specifically relates to solid cleaning compositions where a hydrated salt forms a foundation for the solid cleaning composition where additional ingredients can be added to a melt of the hydrated salt.

BACKGROUND OF THE INVENTION

Cleaning compositions are sold for cleaning a variety of articles ranging from laundry, hard surfaces, cookware, vehicles, floors, walls and among others. Many of these cleaners are powders that are manually scooped into water and dissolved. For some applications, concentrated liquids have been found to be highly desirable by certain consumers. Powders have the disadvantage that they are susceptible to degradation upon exposure to moisture or humidity. Liquids have the disadvantage of being bulky and potentially hazardous if spilled. Therefore, solid cast cleaners have been developed primarily for commercial or institutional applications where efficient handling of the cleaning product can be particularly advantageous.

Several types of solid form cleaning compositions have been commercially available. The different types have the common feature that a compound or group of compounds form a foundation for manufacturing the solid cleaner. The foundation compounds are typically present in at least 15 percent by weight of the cleaning composition up to 80 percent or more. The foundation compounds are relatively easily melted, and the melted forms of the foundation compounds support the addition of other ingredients to form a melt or dispersion that will solidify into the final cleaning composition. Two methods have been used for producing solid detergents depending on the nature of the foundation compounds.

One class of solid cleaners uses surfactants, waxy organic detergent components, as the foundation compounds. The surfactants are melted in the initial step of the manufacturing process. The other ingredients are added to the melt of the surfactant, foundation compounds. These other ingredients may either dissolve in the surfactant melt, melt themselves or disperse from stirring to form a uniform dispersion of discrete but small particles spread through the melt.

One example of a solid detergent using nonionic and anionic surfactant foundation compounds is described in U.S. patent application Ser. No. 08/443,590, now Ser. No. 08/654,782, a continuation thereof, a assigned to the assignee of the present invention, filed May 17, 1995 to Scepanski, entitled Improved. Solid Detergents with Active Enzymes and Bleach. U.S. Pat. No. 4,861,518 to Morganson et al., entitled Non-Filming High Performance Solid Floor Cleaner, describes a floor cleaner based on nonionic and anionic surfactants. In this case, polyethylene glycol with a molecular weight between 3000 and 8000 is a required foundation compound along with the surfactants. The polyethylene glycol and the surfactants are melted together in the first step of the manufacturing.

Another class of these solid cleaners is based on organic (nonsurfactant) or inorganic salts. Various organic (nonsurfactant) and inorganic salts can be significant components of detergent compositions and can serve in many different roles. These roles include as an alkaline builder, a sequestrant, a soil suspender, buffer and as an oxygen bleach. Metasilicate salts are an example of a salt serving as alkaline builders. Examples of sequestering and buffering agents, which remove multivalent cations from solution and control pH, include metaborates, tetraborates, orthophosphates and dihydrogen phosphates. The salts can also provide peroxide bleaching agents, such as perborates. Surfactant salts may have relatively low melting points, but most of these other salt compounds have very high melting points in their anhydrous forms.

Since the anhydrous forms of these salts have high melting points, the salts are mixed under heat with water or aqueous alkali metal hydroxide solution. The water produces hydrated form of the salt which will have a lower melting point, so a melt can be formed of the initial mixture to form a foundation melt. Further ingredients are added to the resulting melted foundation. The foundation compounds can be added to form an initial melt or later as "solidification agents" to remove excess water. The salts that have been used are anhydrous hydroxides, tripolyphosphates, sulphates, acetates, silicates and carbonates.

U.S. Pat. Nos. 4,595,520 and 4,680,134 to Heile et al., entitled Method For Forming Solid Detergent Compositions, disclose the use of either anhydrous sodium sulfate or anhydrous sodium carbonate as a solidifying agent, i.e., forming the foundation. A solidifying agent is added to help the final mixture to form a solid upon cooling. Alkali metal hydroxides and tripolyphosphate salts are also in the detergents. The alkali metal hydroxide can be partly or completely replaced by an alkali metal silicate (or metasilicate) at a concentration between 20 to 30 percent by weight. The solidification compounds and the hydroxides contribute to the foundation.

U.S. Pat. No. 4,846,989 to Killa, entitled Solid Cast Warewashing Composition and Process for Preparing the Same, discloses a cleaning composition with 20 to 30 percent by weight alkali metal metasilicate along with an effective amount of water of hydration. In this patent, the cleaning composition is formed by making an aqueous solution of alkali metal hypochlorite and adding the rest of the ingredients including the metasilicate under constant mixing. The resulting solution is heated until poured into containers.

U.S. Pat. No. 5,080,819 to Morganson et al., entitled Low Temperature Cast Detergent-Containing Article and Method of Making and Using, discloses a cast detergent composition formed by starting with a heated aqueous solution of alkali metal hydroxide. Other ingredients including a nonionic surfactant and a hardness sequestering agent are added into this hydroxide solution. U.S. Pat. Nos. Re. 32,818 and U.S. Pat. No. Re. 32,763 to Fernholz et al., entitled Cast Detergent-Containing Article and Method of Using, describes solid detergent compositions that similarly begin with an aqueous alkali metal hydroxide solution. These detergent compositions do not contain the nonionic surfactant.

U.S. Pat. No. 5,340,501 to Steindorf, entitled Solid Highly Chelated Warewashing Detergent Composition Containing Alkaline Detersives and Aminocarboxylic Acid Sequestrants, reports a detergent composition that is formed from a molten melt of water, alkaline source, such as potassium hydroxide, potassium silicate and potassium oxide, and an aminocarboxylic acid sequestrant. A solidification agent can be added to accept any excess water for hydration. Solidification agents can include alkali metal hydroxides, alkali metal phosphates, anhydrous sodium carbonate, anhydrous sodium sulfate and anhydrous sodium acetate.

U.S. Pat. No. 5,397,506 to Groth et al, entitled Solid Cleaner, uses a mixture of polyethylene glycol, urea and sodium acetate as a casting agent. This cleaner would seem to be somewhat different in its formation. The sodium acetate must be soluble in the melted polyethylene glycol. There is no indication that the sodium acetate is hydrated.

The underlying principle in the formation of the detergents starting with water and salt mixtures is that the hydrated form of the salts have significantly lower melting points than the anhydrous forms. Therefore, it would be significantly more difficult to melt the anhydrous forms of the salts. Mixing the water and the salt together under heat forms the melt of the hydrated salt. With some salts, though, the formation of the hydrated salt does not occur under these conditions or is too slow to be useful.

Only, two basic processes have been used in the production of solid cleaning compositions. The processes noted above are limited in terms of the range of salts that can be successfully incorporated into the cleaning composition based on using the salts as the foundation supporting the cleaning composition.

SUMMARY OF THE INVENTION

A method for forming solid cleaning agents starts with hydrated forms of salts that generally have considerably lower melting points in their hydrated forms. The hydrated salt cleaning agents are heated to form a melted cleaning suspension. The hydrated salt cleaning agent comprises at least about 15 percent by weight of the cleaning composition. Additional ingredients can be mixed into the melted cleaning suspension. These additional ingredients can be selected from the group consisting of nonionic surfactants, anionic surfactants, alkaline builders, multivalent metal sequestering agents, cationic emulsifiers, active cleaning enzymes, soil suspending agents, defoamers, oxygenated solvents, fragrances, optical brighteners and colorants. The melted cleaning compositions are poured into a receptacle. Upon cooling, the suspension solidifies into the solid cleaning composition.

An alternative method involves the formation of a mixture of powder or granular cleaning composition components. These components include at least about 15 percent by weight of a moderate melting point cleaning additive. The moderate melting point cleaning additive is either a surfactant or a hydrated salt cleaning agent. The mixed powder or granular components are placed in a receptacle. The receptacle with the cleaning components is heated to a temperature above the melting point of the moderate melting point cleaning additive. After sufficient time, the heating is stopped, and the mixture solidifies into a solid cleaning composition.

A class of novel solid cleaning compositions comprises at least about 25 percent of a hydrated melt salt cleaning agents. A hydrated melt salt cleaning agent is defined to be a salt that has a hydrated form with a significantly lower melting point than the anhydrous form but that does not form the hydrated form effectively when mixed with sufficient hydration water at a temperature somewhat above the melting point of the hydrated salt. The hydrated metal salt can serve the role in the cleaning composition of an alkaline builder, a multivalent metal sequestering agent or a peroxide bleach. The hydrated metal salt can have an anion selected from the group consisting of orthophosphates, hydrogen orthophosphates, dihydrogen orthophosphates, metaphosphates, tetraborates, metaborates, perborates, and mixtures thereof.

DETAILED DESCRIPTION OF THE INVENTION

Water soluble hydrated salts form the foundation for the cleaning compositions within the invention. The particular salt selected will be based on the end use envisioned for the product and the selected method of production. Various additional cleaning agents can be blended with the salt foundations to produce the overall cleaning properties needed.

The foundation salts within the invention do not usually include surfactant salts, and they will be generally inorganic. These nonsurfactant salts will be called salt cleaning agents. This reflects the fact that they form a significant portion of the cleaning composition and will generally contribute important properties to the cleaning composition. The salt cleaning agents will generally be present in concentrations of the salt greater than about 15 percent by weight of the anhydrous form of the salt relative to the weight of the cleaning composition. It should be noted that the salt cleaning agents can also be incorporated into solid cleaners in various concentrations that use other compounds for their foundation.

The salts of particular interest have high melting points in their anhydrous form and much lower melting points in their hydrated form. The melting points of the hydrated forms are still higher than typical room temperatures of 60° to 90° F. (16°–34° C.). Table 1 presents the melting points of some of the salts of interest.

TABLE I

Melting Points of Anhydrous and Hydrated Salts

| INGREDIENT | MELTING POINT °C. |
|---|---|
| Sodium Metasilicate ($Na_2SiO_3$), Anhydrous | 1088° C. |
| Sodium Metasilicate.$5H_2O$ | 72° C. |
| Sodium Metasilicate.$9H_2O$ | 44° C. |
| Sodium Metaborate ($NaBO_2$), Anhydrous | 966° C. |
| Sodium Metaborate.$4H_2O$ | 57° C. |
| Sodium Tetraborate ($Na_2B_4O_7$), Anhydrous | 741° C. |
| Sodium Tetraborate.$10H_2O$ | 75° C. |
| Sodium Perborate.$3H_2O$ ($NaBO_2.H_2O_2.3H_2O$) | 63° C. |
| Sodium Orthophosphate.$10H_2O$ ($Na_3PO_4.10H_2O$) | 100° C. |
| Sodium Orthophosphate.$12H_2O$ | 75° C. |
| Sodium Dihydrogenphosphate.$2H_2O$ ($NaH_2PO_4.12H_2O$) | 60° C. |

Two general methods of preparation can be used within the invention. These methods are novel methods for the formation of cleaning compositions. A third, known method can be used to produce certain cleaning products based on foundation salts. In this method, the starting material is the anhydrous form of the foundation salt. The hydrated form of the foundation salt is formed in-situ. The anhydrous salt and water are added to the mixing vessel and mixed. The water can be added in the form of an aqueous solution of additional ingredients.

This third method can only be used with particular foundation salts which form the hydrated form of the salt at a reasonable rate when sufficient hydration water is added to the anhydrous salt at a temperature somewhat above the melting point of the hydrated salt. The salts that are not appropriate for processing by this third method will be called hydrated melt salt cleaning agents. Hydrated melt salt cleaning agents do not effectively form the hydrated forms of the salt under these conditions.

When the third method is attempted with the hydrated melt salt cleaning agents, a melt of the hydrated salt does not form after stirring the salt and sufficient hydration water at temperatures high enough to melt the hydrated salt. When stirring is stopped after a reasonable period of time, e.g. about 30 minutes, water separates indicating that the hydrate was not formed. This water-salt mixture that does not form the hydrated salt does not provide a reasonable foundation for the formation of a solid cleaning composition. If a suitable salt cleaning agent is mixed with hydration water while appropriately heated, a melt with the consistency of a creamy pudding is formed that does not significantly separate if heating is stopped.

The melt salt cleaning agents include hydrated alkali metal salts of ortho phosphates, hydrogen orthophosphates, dihydrogen orthophosphates, metaphosphates, tetraborates, metaborates and perborates. The orthophosphates and the metaphosphates are effective multivalent metal ion sequestering agents which are useful in cleaning compositions as described below and would be most useful in large concentrations in hard surface cleaners and the like. The tetraborates and metaborates are useful in cleaning compositions as alkali builders and would be most useful in large concentrations in laundry applications. The perborates are peroxide bleaches that can be useful in a variety of applications especially in laundry detergents. Simple experiments can be used to determine other melt salt cleaning agents.

Specific examples of the melt salt cleaning agents include trisodium orthophosphate dodecahydrate, trisodium orthophosphate decahydrate, sodium dihydrogen orthophosphate dihydrate, disodium hydrogen orthophosphate heptahydrate, disodium hydrogen orthophosphate dodecahydrate, sodium trimetaphosphate heptahydrate, sodium tetraborate decahydrate, sodium perborate trihydrate, sodium metaborate tetrahydrate, and mixtures thereof.

The first procedure for producing the solid cleaning compositions directly makes use of the melting properties of the hydrated foundation salts. The foundation material, i.e., the hydrated salt, is added to a mixing vessel that has a propeller, turbine or other suitable mixing apparatus for viscous liquids. The material is heated by electric, steam, oil or water recirculation through a heat exchanger or other suitable method to melt the foundation salt. Mixing is started once the material is fluid.

While stirring the fluid, the other ingredients are added while monitoring the temperature and viscosity of the batch. These additional ingredients may either dissolve in the melted foundation salt, melt themselves or form a dispersion within the melt. If the temperature decreases or the viscosity increases, heat is applied to raise the temperature to lower the viscosity enough to keep the mass fluid and the mixture homogeneous.

As the last ingredients are to be added, the temperature is allowed to decrease, so the viscosity increases to the thickness that is proper for packaging. At the proper viscosity for packaging, the mixture is fluid enough to extrude through a tank drain valve but thick enough to prevent any undissolved but dispersed particulate ingredients from settling during the time required for cooling and solidification of the finished product in the package. For packaging, the molten, homogeneous mixture is poured into a form that can be a plastic bottle, a mold or a flat sheet. The forms are cooled after the molten mixture is poured into the appropriate form. The cooling and solidification process can take from 30 minutes to 24 hours depending on formulation and the surrounding temperature in the storage vicinity.

The second procedure also uses the hydrated form of the foundation salt. The foundation salt is mixed with the other ingredients where all of the ingredients are in either powder or granular form to make a mechanical, effectively homogeneous mixture of the ingredient particles. The powder mixture is packed into receptacles, e.g., either a mold or a container. Preferably, the receptacle is a plastic bottle. The bottles with the powder mixture are stored at approximately 10°–30° F. above the melting point of the hydrated foundation salt. Appropriate foundation salts would preferably have melting points between 80° F. and 300° F., more preferably between 100° F. and 250° F., and even more preferably between 120° F. and 220° F.

Upon storage for sufficient time at this elevated temperature, a molten, highly viscous mixture is created. The sufficient amount of time will vary depending on the exact ingredients used but will generally range between 8 to 24 hours. The product should not be stored at elevated temperatures for too long of a period of time to prevent the separation and stratification of the dispersed components of the mixture.

Upon being cooled, the product solidifies into a solid mass containing an effectively homogeneous mixture of ingredients. This method of producing the cleaning composition can consume greater amounts of energy since the entire mixture must be heated for the periods of time needed to form the melted mixture. The method does have the advantage that equipment is not needed for handling and stirring the melted cleaning composition. This second method is novel for the production of all solid cleaning compositions including those based on surfactant foundations.

A variety of standard cleaning ingredients can be added to the foundation salt to form the final cleaning composition. These additional ingredients can be in concentrations of less than one percent to about 85 percent. In the formation of detergents, anionic and nonionic surfactants can be included. Total surfactant concentrations will range from 0% to 85% by weight of detergent. Particular nonionic surfactants which can be used in detergents of the invention include:

- Nonylphenol ethoxylates with 4–100 ethylene oxide groups per nonylphenol molecule, i.e., nonylphenol $(\text{ethoxylate})_n$, n=4–100
- Dinonylphenol ethoxylates with 4–150 ethylene oxide groups per dinonylphenol molecule
- Linear alcohol ethoxylates with the alcohol chain consisting of 6–24 carbon atoms and with 2.5 to 150 ethylene oxide groups per alcohol molecule
- Dodecylphenol ethoxylates with 4–100 ethylene oxide groups per dodecylphenol molecule
- Octylphenol ethoxylates with 4–100 ethylene oxide groups per octylphenol molecule
- Alkanolamides in which the carbon chain consists of a $C_{12}$–$C_{18}$ fatty acid reacted with mono or diethanolamine or isopropanolamine to yield a product having a melting point above 100° F.
- Ethoxylated alkanolamides in which the carbon chain consists of a $C_{12}$–$C_{18}$ fatty acid reacted with ethylene oxide and mono or diethanolamine or isopropanolamine
- Amine oxides having a carbon chain from $C_8$ to $C_{18}$
- Fatty acid ethoxylates with 2–40 ethylene oxide per fatty acid where the fatty acid has a carbon chain from $C_8$ to $C_{18}$ Ethylene oxide/propylene oxide (eo/po) block copolymers with average molecular weights between 1,000 and 15,000

Nonylphenol ethoxylate propoxylates with average molecular weights between 400–8000

Linear alcohol ethoxylate propoxylates with average molecular weights between 400–8000 and carbon chains from $C_8$ to $C_{18}$.

Concentrations of nonionic surfactants in detergent compositions will generally be between 0 and 75 percent by weight. The specific nonionic surfactant will be selected to have the best cleaning properties for an appropriate cost given the intended use for the cleaning composition. For laundry applications, nonylphenol ethoxylates and linear alcohol ethoxylates are preferred nonionic surfactants. For metal cleaning, dodecylphenol ethoxylates and octylphenol ethoxylates are preferred. For cleaning food processing equipment, amides and amine oxides are preferred. Anionic surfactants will be used in concentrations between 0 to 75 percent by weight of detergent. Anionic surfactants which could be included in this product include, but are not limited to, all of the following:

1. Alkyl sulfonate salts and alkylaryl sulfonate salts, supplied with the sodium, potassium, ammonium, protonated mono, di or tri-ethanolamine or protonated isopropanolamine cations, such as the following salts:
   Linear primary $C_6$–$C_{18}$ sulfonate salt
   Linear secondary $C_3$–$C_{18}$ sulfonate salt
   Alpha Olefin sulfonate salt
   Dodecylbenzene sulfonate salt
   Tridecylbenzene sulfonate salt
   Xylene sulfonate salt
   Cumene sulfonate salt
   Toluene sulfonate salt
2. Alkyl sulfates salt and alkylaryl sulfate salts, supplied with either Na, K, $NH_4$, protonated mono, di or tri-ethanolamine or protonated isopropanolamine cations, such as the following salts:
   Linear primary $C_6$–$C_{18}$ sulfate salt
   Linear secondary $C_3$–$C_{18}$ sulfate salt
   $C_{12}$–$C_{13}$ benzene sulfate salt
3. Alkyl $C_6$–$C_{18}$ naphthalene sulfonate salts with Na, K or $NH_4$ cations.
4. Alkyl $C_6$–$C_{18}$ diphenyl sulfonate salts with Na, K or $NH_4$ cations.
5. Alkyl ether sulfate salts or alkylaryl ether sulfate salts supplied with Na, K, $NH_4$, protonated mono, di or triethanolamine, or protonated isopropanolamine cations, such as the following salts:
   Alkyl $C_8$–$C_{18}$ alcohol $(ethoxylate)_{1-6}$ sulfate salt.
   Alkyl $C_8$–$C_{12}$, phenoxy $(ethoxylate)_{1-12}$ sulfate salt.
6. Alkyl ether sulfonate salts or alkylaryl ether sulfonate salts supplied with Na, K, $NH_4$, protonated mono, di or tri-ethanolamine or protonated isopropanolamine cations, such as the following salts:
   Alkyl $C_8$–$C_{18}$ alcohol $(ethoxylate)_{1-6}$ sulfonate salt.
   Alkyl $C_8$–C2 phenoxy $(ethoxylate)_{1-12}$ sulfonate salt.
7. $C_4$–$C_8$ dialkyl sulfosuccinate salts supplied with Na, K, $NH_4$, protonated mono, di or tri-ethanolamine or protonated isopropanolamine cations, such as disodium dioctyl sulfosuccinate.
8. Other anionic surfactants such as mono or dialkyl phosphate ester salts, isothionate or taurate salts. Preferred anionic surfactants include sodium dodecylbenzene sulfonate, alpha olefin sulfonate, sodium alkyl $C_{12}$–$C_{15}$ alcohol $(ethoxy)_3$ sulfate. The choice of anionic surfactant will generally be based on the same factors as the choice of nonionic surfactant. The relative amounts of nonionic and anionic surfactants will be based on the cleaning ability desired for the final product since each type of surfactant will tend to work best with certain types of soil.

Cationic emulsifiers can be included in the cleaning compositions to improve removal of greasy or oily soils. The cationic emulsifiers can be added in concentrations between 0 and 10 percent by weight of the cleaning composition. Cationic emulsifiers are known in the art, and appropriate cationic emulsifiers include isodecyloxypropyl dihydroxyethyl methyl ammonium chloride and isotridecyloxypropyl dihydroxyethyl methyl ammonium chloride.

Alkaline builders are water soluble bases added to cleaning compositions to raise the pH of the resulting cleaning solution. The alkaline builders have cleaning ability of their own, and they improve the function of the surfactants. The foundation salt may or may not be an alkaline builder. The cleaners of this invention include 0 to 100 percent by weight alkaline builder, noting that the foundation salt can be an alkaline builder. The amount of alkaline builder used will depend on the relative amounts of cleaning agents desired to achieve the proper cleaning effect. When the alkaline builder is not the foundation salt, too much alkaline builder should not be used such that it will not become properly suspended in the melted salt foundation during the manufacturing process.

Powdered, bead, liquid or granular alkaline builders can be used in the formulation of detergents of the invention. Generally, any water soluble base is appropriate, although certain bases are commonly used as alkaline builders in detergent compositions. Some alkaline builders that can be included in this product are: sodium or potassium silicate, sodium or potassium carbonate, trisodium or tripotassium phosphate, $Na_2HPO_4$, $K_2HPO_4$, sodium hydroxide, potassium hydroxide, monoethanolamine diethanolamine, triethanolamine.

Chelating, sequestering or scale inhibiting ingredients are added to the detergent to neutralize the adverse consequences of having divalent and trivalent ions of calcium, magnesium, and iron and other less significant polyvalent metal cations in the washing solution. These divalent and trivalent cations enter the cleaning system with the water that is used as the main solvent in washing and rinsing, and with the soils present in the system that are to be removed. These divalent and trivalent ions reduce the effectiveness of detergents. Subsequent reference to "hardness ions" refers to calcium, magnesium and, to a lesser degree, iron and other cations which are found in "hard water".

With the use of anionic surfactants, the hardness ions can combine with the anionic surfactant which not only reduces the surfactant's utility in solubilizing unwanted materials, but which can also precipitate the surfactant. If the surfactant precipitates, this adds to the soil with precipitated surfactant instead of removing it. The precipitated surfactant results, for example, in greasy films on hard surfaces or in gray to yellow tints on fabrics when used in laundry detergents.

Hardness ions can also precipitate fatty acids present in soils to prevent the solubilization and removal of the fatty acids by the surfactants. Inorganic anions such as carbonate, phosphate, silicate, sulfate, hydroxide and others can precipitate with hardness ions to form inorganic films, spots or deposits on hard surfaces and cleaning machines and devices or to form graying and discoloration of fabrics from the deposit of inorganic particles. We use the term sequestering to cover generally chelating and sequestering of polyvalent metal ions that interfere with the cleaning process when free in solution.

Sequestering chemicals will prevent these adverse effects because they bind the hardness ions. Binding of the sequestering agent to the ions keeps the hardness ions in solution and prevents the hardness ions from precipitating with the aforementioned organic and inorganic anions. Therefore, addition of sequestering agents prevents mineral scale from building up on cleaning equipment, hard surfaces or fabrics being cleaned and promotes the rinsing of any residual hardness ion/sequestering agent complex that may have dried onto the substrate during the cleaning process.

The foundation salt may or may not be a hardness metal sequestering agent. Sequestering agents will be present in the cleaning compositions of the invention at concentrations between 0 and 50 percent by weight of cleaning composition. Well known sequestering agents can be used in this invention, including, but not limited to, the following which are commercially available and commonly used in detergent formulations:

1. Sodium, potassium, and ammonium salts of orthophosphate or polyphosphates such as pyrophosphate, tripolyphosphate, trimetaphosphate, hexameta phosphate or other higher complex phosphates having up to 22 phosphorus atoms in the anion.
2. Ethylenediamine tetraacetic (EDTA) acid or its fully or partially neutralized salts, e.g., sodium, potassium, ammonium or mono, di or triethanolamine salts.
3. Nitrilotriacetic (NTA) acid $N(CH_2CO_2H)_3$ or its full or partially neutralized salts, e.g., sodium, potassium, ammonium or mono, di or triethanolamine salts.
4. Other aminocarboxylic acids and their salts, for example: pentasodium diethylenetriamine pentaacetate trisodium hydroxyethyl ethylenediamine triacetate disodium ethanoldiglycine sodium diethanolglycine
5. Organic polycarboxylic acids and their salts, such as, oxalic acid, citric acid and gluconic acid.
6. Polyacrylic acid polymers and the sodium, potassium, ammonium or mono, di or triethanolamine salts from molecular weight 800 to 50,000.
7. Copolymers, of acrylic and maleic acid and the sodium, potassium, ammonium or mono, di or triethanolamine salts with molecular weights greater than 800.
8. Copolymers, of acrylic acid and itaconic acid and the sodium, potassium, ammonium or mono, di or triethanolamine salts with molecular weights between 800–50,000.
9. Copolymers, of maleic acid and itaconic acid and the sodium, potassium, ammonium or mono, di or triethanolamine salts with molecular weights between 800–50,000.
10. Amino trimethylene phosphonic acid and its sodium, potassium, ammonium or mono, di or triethanolamine salts.
11. 1-Hydroxyethylidine-1,1-diphosphonic acid and its sodium, potassium, ammonium or mono, di or triethanolamine salts.
12. Hexamethylenediamine tetra(methylenephosphonic acid) and its sodium, potassium, ammonium or mono, di or triethanolamine salts.
13. Diethylene triamine penta(methylene phosphonic acid) and its sodium, potassium, ammonium or mono, di or triethanolamine salts.
14. Dequest 2041™ by Monsanto, which is a similar substituted phosphonic acid or salt.

The cleaning compositions of the invention can contain soil suspending agents. The soil suspending agents will be present in concentrations between 0 and 10 percent by weight of cleaning composition. The soil suspending agents within the invention include carboxymethylcellulose and polyvinylpyrrolidone. Soil suspending agents would most likely be used for laundry applications.

When the cleaning composition contains surfactants, it may be desirable to include defoamers. These defoamers will be present in concentrations between 0 and 5 percent by weight of cleaning composition. Appropriate defoamers in the invention include defoamers well known in the art. Appropriate defoamers are chosen from the many available and include dimethyl siloxane polymers.

Oxygenated solvents such as alcohols, glycols and glycol ethers can be added in small amounts, up to about 10 percent by weight of the cleaning composition. Preferred solvents include ethylene glycol monobutyl ether and .dipropylene glycol methyl ether.

Cleaning compositions within the invention can include active enzymes that are effective to enhance cleaning. Enzymes that can be included in this type of invention include protease, amylase, lipase and cellulase enzymes. Each of these types of enzymes will occur in concentrations between 0 and 20 percent by weight of cleaning composition. Protease enzymes are particularly effective in enhancing the cleaning performance of detergents. Many manufacturers of enzymes offer products directed toward the detergent industry for use in cleaning products. Enzymes which could be included in this product, but are not limited to all of the following:

| | Manufacturer |
|---|---|
| Protease | |
| Alcalase ™ | Novo Nordisk A/S |
| Esperase ™ | Novo Nordisk A/S |
| Savinase ™ | Novo Nordisk A/S |
| Optimase ™ | Solvay Enzymes |
| Opticlean ™ | Solvay Enzymes |
| Maxacal ™ | Gist Brocades Industries |
| Maxatase ™ | Gist Brocades Industries |
| Amylase | |
| Termamyl ™ | Novo Nordisk |
| Optimase PAL, PAG ™ | Solvay Enzymes |
| Opticlean M. Solvay Amulase MT ™ | Solvay Enzymes |
| Rapidase ™ | Gist Brocades Industries |
| Cellulase | |
| Cellusoft ™ | Novo Nordisk |
| Lipase | |
| Lipolase ™ | Novo Nordisk |
| Pancreative Lipase 250 ™ | Solvay Enzymes |

Additional ingredients, which are often added to cleaning formulations, may or may not be added to the invention including fragrances, optical brighteners, colorants, and the like. These are added in concentrations generally ranging from 0 to 10 percent by weight.

The molten cleaning composition is poured into some kind of receptacle, a container or a mold, where it solidifies into the final product. Depending on the type of receptacle, the final product can take two forms. First, and primarily, the cleaning composition is poured into a container while still melted. The cleaning composition solidifies in the container on cooling. Second, the melted cleaning composition can be poured into open molds where the composition solidifies on cooling. In the molds, the cleaning composition forms blocks of the finished product.

In the preferred embodiment, the melted cleaning composition is solidified in a plastic container, typically 1 quart to 6 quarts capacity. Larger plastic or plastic lined fiber drums up to 55 gallons could be used where the dispensing equipment is scaled up to accommodate the larger sizes. The opening on top of the container will generally be larger than 39 mm in diameter to fit standard dispensing equipment.

For dispensing, the plastic bottle can be inverted into a bowl where water is sprayed up onto the exposed surface, dissolving an appropriate amount of cleaning composition. The resulting cleaning solution is transferred to the use application. If the intended application is a laundry use, the usage rates may vary from 1 oz. to 50 oz. per 100 pounds of fabric depending on the soil conditions and load. If the intended application of the cleaning solution is for hard surface cleaning, the concentration of cleaning composition would typically be ½ to 10 oz. cleaning composition per gallon of water. Appropriate concentrations can be easily determined for other applications.

In the molded block form, the appropriate number of blocks are simply added to the solution to achieve the desired concentration. For example, if the blocks are 1 oz. each and the intended use is for institutional laundry where 4 oz. of detergent are needed, four blocks of detergent would be added to the machine during the wash cycle. If the cleaning composition is to be used for mopping and cleaning floors, one block is put into the bucket either before, during or after the addition of water to the bucket.

Washing tests were run on some detergent formulations of the invention in a top load washer using 1 ounce of detergent at 140° F. Test swatches were prepared by staining 6"×6" pieces of white 100% cotton and white 100% polyester (VISA) with grass, grape juice, barbecue sauce, French dressing, lipstick, shoe polish, ink, Hibiclens™. These tests demonstrate the excellent cleaning effectiveness of the cleaning compositions of the invention.

EXAMPLES 1–6

A 530 gram quantity of sodium metasilicate, pentahydrate is weighed into a 1000 ml beaker. The beaker is placed on a hot plate and slowly heated. A lab sized Lightning Mixer™ with a propeller agitator is placed in the beaker with the bottom blade about ¼ inch above the bottom of the beaker. The mass is slowly heated with the mixer periodically turned on to stir the material. The material becomes fluid at a temperature of about 170° F.

Next, 250 grams of anhydrous sodium tripolyphosphate are slowly added with constant stirring. The heat is continued to keep the temperature above 170° F. In order, 50 grams of sodium hydroxide beads and 100 grams of Neodol 25–7™ (manufactured by Shell Oil Co.), ethoxylated linear alcohols ($C_{12}$ to $C_{15}$) with 7 moles of ethoxylate per mole of alcohol, are added, and heating is discontinued. Finally, 20 grams of carboxymethylcellulose and 50 grams of sodium dodecylbenzene sulfonate are added. The final mixture is agitated until it cools to 165° F. at which the mixture is thick yet flowable and can be poured into a plastic bottle. A comparable cleaning composition was prepared with T-Det N9.5™ (manufactured by Harcross), Nonylphenol (ethoxylate)$_{9.5}$. These cleaning compositions were shown to be effective laundry detergents with excellent cleaning effectiveness.

Table 2 presents five additional compositions using sodium metasilicate as the foundation salt prepared based on the procedure described above appropriately modified for the changes in composition. The values given are weight percents of the total cleaning composition. Compositions 1–4 would be expected to be effective laundry detergents while composition 5 would be expected to be an effective hard surface cleaner.

TABLE 2

| MATERIAL | 1 | 2 | 3 | 4 | 5 |
|---|---|---|---|---|---|
| Sodium Metasilicate Pentahydrate | 62 | 55 | 75 | 58 | 65 |
| Trisodium NTA.$H_2O$ | 0 | 20 | 0 | 25 | 0 |
| Sodium Tripolyphosphate ($Na_5P_3O_{10}$) | 20 | 10 | 20 | 0 | 25 |
| Nonionic Surfactant[1] | 8 | 6 | 5 | 6 | 0 |
| Anionic Surfactant[2] | 2 | 4 | 0 | 6 | 0 |
| Sodium Hydroxide | 8 | 0 | 0 | 5 | 6 |
| Potassium Hydroxide | 0 | 5 | 0 | 0 | 0 |
| Defoamer[3] | 0 | 0 | 0 | 0 | 4 |

[1]Neodol 25-T ™ or T-Det N9.5 ™
[2]Calsoft 90F ™, sodium dodecylbenzene sulfonate, manufactured by Pilot
[3]Pluronic 25-R-2 ™ manufactured by BASF

EXAMPLES 7–10

First, 840 grams of trisodium (ortho)phosphate dodecahydrate (TSP•12$H_2O$) are added to a 1000 ml beaker. The beaker is placed on a hot plate with a propeller type agitator ¼ inch about above the bottom of the beaker. Low heating with occasional mixing is applied to slowly raise the temperature to 160° F. After the salt is liquid, the agitator is run continuously throughout the rest of the procedure. In order, 50 grams of dioctyl sulfosuccinate (70% active, 30% water), 20 grams of Dequest 2000™ (manufactured by Monsanto) and 90 grams of lauryl dimethyl amine oxide (30% active, 70% water) are added to the melt, keeping the temperature between 170° to 180° F. with continuous heating.

The melt is allowed to cool to 170° F. to achieve a desirably thicker viscosity for packaging. The melted cleaning composition was poured into a plastic jug where it solidified at about 140° F. The product was demonstrated to be a relatively mild but effective degreaser for floors, walls, counter tops and food processing equipment. Table 3 displays a number of other useful cleaning compositions produced using TSP•12$H_2O$ as the base material.

TABLE 3

| | 1 | 2 | 3 |
|---|---|---|---|
| TSP.12$H_2O$ | 65 | 77 | 69 |
| $Na_4$ EDTA | 5 | 0 | 0 |
| $Na_3$ NTA | 0 | 5 | 10 |
| Anionic[1] Surfactant | 5 | 10 | 5 |
| Nonionic Surfactant[2] | 5 | 5 | 10 |
| Sodium Tripolyphosphate Hexahydrate | 15 | 0 | 0 |
| Glycol Ether[3] | 5 | 3 | 6 |

[1]Sodium Lauryl Sulfate Powder, Witcolate A ™ manufactured by Witco
[2]Octylphenol (ethoxylate)$_9$, T-Det 9 ™ manufactured by Harcross
[3]Dowonol EB ™, ethylene glycol monobutyl ether, manufactured by Dow Chemical

EXAMPLES 11–12

Sodium perborate trihydrate was melted by heating 1000 grams to 140° F. in a beaker on a hot plate with periodic stirring. The melted hydrated salt was poured into a plastic bottle where it solidified. Perborates are known to be effective peroxide bleaches. This product is useful as a bleaching or whitening additive for laundering fabrics or in cleaning porous, stained hard surfaces.

A detergent can also be produced from the sodium perborate trihydrate foundation. First, 750 grams of sodium perborate trihydrate were added to a 1000 ml beaker and heated with mixing to 140° F. After the material Was melted, 100 grams of sodium tripolyphosphate, 100 grams of trisodium nitrilotriacetate and 50 grams of dodecylbenzene sulfonate were added and mixed until effectively homogeneous. The melted cleaning product was poured into a plastic bottle where it solidified in less than 24 hours at room temperature. This product is an effective stain removing detergent for food stains on porcelain, plastic eating and drinking utensils and sinks. This was demonstrated from the removal of coffee stains from cups and pots.

EXAMPLE 13

A mixture of 700 grams of TSP•12 $H_2O$, 250 grams of trisodium NTA, 25 grams of sodium dodecylbenzene sulfonate (Calsoft 90™, manufactured by Pilot) and 25 grams of dinonylphenol ethoxylate (Igepal DM970™ manufactured by Rhone-Poulenc) were placed into a plastic bottle. Each of the components was in powder form when placed in the bottle. The plastic bottle was heated to 180° F. in an oven for four hours with no additional mixing. The bottle was removed from the oven and allowed to cool. The cleaning composition solidified into a solid mass.

The above examples are representative and do not demonstrate the full range of cleaning compositions included within the invention. Generally, commercial quantities can be produced by linearly scaling the ingredients according to the total quantity desired. In any case, a person of ordinary skill in the art can straightforwardly scale the procedure to produce commercial quantities. The quantities of ingredients referred to in the claims refer to the anhydrous form of the ingredients, when appropriate even when the hydrated form of the salt is specified.

I claim:

1. A solid cleaning composition consisting of:

at least about 15% by weight of a hydrated salt cleaning agent selected from the group consisting of trisodium orthophosphate dodecahydrate, trisodium orthophosphate decahydrate, sodium dihydrogen orthophosphate dihydrate, disodium hydrogen orthophosphate heptahydrate, disodium hydrogen orthophosphate dodecahydrate, sodium trimetaphosphate heptahydrate, sodium perborate trihydrate, and mixtures thereof;

between about 5% and 80% by weight surfactant, the surfactant selected from the group consisting of nonionic surfactants, anionic surfactants and any mixture thereof;

between about 5% and 50% by weight of a multivalent metal sequestering agent selected from the group consisting of anhydrous sodium tripolyphosphate, aminocarboxylic acids or salts thereof, polycarboxylic acids or salts thereof, polyacrylic acid polymers, copolymers of acrylic acid and maleic acid or salts thereof, copolymers of acrylic acid and itaconic acid or salts thereof, copolymers of maleic acid and itaconic acid or salts thereof, and aminophosphonic acids or salts thereof; and between about 5% and 50% by weight of an alkaline builder selected from the group consisting of sodium or potassium silicate and sodium or potassium carbonate; in which the cleaning composition is an effectively homogeneous cast solid.

2. A solid cleaning composition consisting of:

about 53% by weight Sodium metasilicate pentahydrate;

about 25% by weight anhydrous Sodium tripolyphosphate;

about 5% by weight Sodium hydroxide;

about 10% ethoxylated linear alcohols with carbon chain lengths ranging between about $C_{12}$ and $C_{15}$ and with about 7 moles ethoxylate per mole of alcohol;

about 2% Carboxymethyl cellulose; and about 5% Sodium dodecylbenzene sulfonate.

3. A solid cleaning composition consisting of:

about 65% by weight Trisodium orthophosphate dodecahydrate or Trisodium phosphate dodecahydrate;

about 5% by weight Sodium ethylenediaminetetraacetic acid;

about 5% by weight Sodium lauryl sulfate;

about 5% by weight Octylphenol ethoxylate with about 9 moles ethoxylate per mole alcohol; about 15% by weight Sodium tripolyphosphate hexahydrate; and about 5% by weight ethylene glycol monobutyl ether.

* * * * *

UNITED STATES PATENT AND TRADEMARK OFFICE

CERTIFICATE OF CORRECTION

PATENT NO. : 5,670,473

DATED : September 23, 1997

INVENTOR(S) : William H. Scepanski

It is certified that error appears in the above-identified patent and that said Letters Patent is hereby corrected as shown below:

In the Abstract, lines 20-21, "at least 15 percent a hydrated melt" should read --at least 15 percent of a hydrated melt--.

Column 1, line 17, "floors, walls and among others." should read --floors, walls, as well as other articles.--.

Column 1, line 32, " present in at least" should read --present in amounts of at least--.

Column 1, line 53, "thereof, a assigned to" should read --thereof, assigned to--.

Column 3, line 19, "Only, two" should read --Only two--. Column 3, lines 57-58, "salt cleaning agents.", should read --salt cleaning agent.--.

Column 5, line 18, "salts of ortho phosphates," should read --salts of orthophosphates--.

Column 7, line 18 "start a new paragraph with "Anionic".

Column 7, line 52, "$C_{12,}$" should read --$C_{12}$--. Column 7, line 59, "Alkyl $C_8$-C2" should read--$C_8$-$C_{12}$--.

UNITED STATES PATENT AND TRADEMARK OFFICE

CERTIFICATE OF CORRECTION

PATENT NO. : 5,670,473

DATED : September 23, 1997

INVENTOR(S) : William H. Scepanski

It is certified that error appears in the above-identified patent and that said Letters Patent is hereby corrected as shown below:

Column 7, line 60, "$C_4$-$C_8$" should read --$C_4$-$C_{18}$.

Column 9, line 25, "phosphorus" should read --phosphorous--.

Column 9, lines 34-36 "pentasodium diethylenetriamine pentaacetate trisodium hydroxyethyl ethylenediamine triacetate disodium ethanoldiglycine sodium diethanolglycine" should read --pentasodium diethylenetriamine pentaacetate, trisodium hydroxyethyl ethylenediamine triacetate, disodium ethanoldiglycine, sodium diethanolglycine.--.

Column 9, line 56, "1,1" should read --1, 1--.

Column 10, line 17, "and .dipropylene" should read --and dipropylene--.

Column 10, line 32, "Manufacturer" should read --<u>Manufacturer</u>--, moreover --<u>Manufacturer</u> should appear in line 34 instead of line 32.

Column 10, line 41, "<u>Amylase</u>" should appear in line 42 and --<u>Manufacturer</u>-- should appear opposite "<u>Amylase</u>" in the second column of line 42.

UNITED STATES PATENT AND TRADEMARK OFFICE

CERTIFICATE OF CORRECTION

PATENT NO. : 5,670,473

DATED : September 23, 1997

INVENTOR(S) : William H. Scepanski

It is certified that error appears in the above-identified patent and that said Letters Patent is hereby corrected as shown below:

Column 10, line 45, "Cellulase" should appear in line 46 and --Manufacturer-- should appear opposite "Cellulase" in the second column of line 46.

Column 10, line 47, "Lipase" should appear in line 48 and --Manufacturer-- should appear opposite "Lipase" in the second column of line 48.

Column 12, line 46, "TSP.12$H_2O$" should read --TSP·12$H_2O$--. Column 12, line 56, "T-Det 9™" should read --T-Det O-9™--.

Column 13, line 4, "140°F.After the material Was melted," should read --140°F. After the material was melted,--.

Column 14, lines 40-43 "about 5% by weight Octylphenol ethoxylate with about 9 moles ethoxylate per mole alcohol; about 15% by weight Sodium tripolyphosphate hexahydrate; and about 5% by weight ethylene glycol monobutyl ether." should read -- about 5% by weight Octylphenol ethoxylate with about 9 moles ethoxylate per mole alcohol; about 15% by weight Sodium tripolyphosphate hexahydrate; and about 5% by weight ethylene glycol monobutyl ether.--.

Signed and Sealed this

Third Day of March, 1998

*Attest:*

*Attesting Officer*

BRUCE LEHMAN

*Commissioner of Patents and Trademarks*